US005366428A

United States Patent [19]

Liao

[11] Patent Number: 5,366,428

[45] Date of Patent: Nov. 22, 1994

[54] GYMNASTIC APPARATUS CAPABLE OF ANIMATING HORSE RIDING

[76] Inventor: Nien-Yuan Liao, No. 264, Sec. 2, Shi-Ting Rd., Yaichung,

[21] Appl. No.: 212,936

[22] Filed: Mar. 15, 1994

[51] Int. Cl.[5] ..... A63B 69/06; A63B 21/068

[52] U.S. Cl. ..... 482/96; 482/57; 482/72

[58] Field of Search ..... 482/57, 72, 95, 96; 280/1.182, 1.183, 1.192, 1.203, 1.204

[56] References Cited

U.S. PATENT DOCUMENTS

| | | | |
|---|---|---|---|
| 2,924,456 | 2/1960 | Miller | 482/96 |
| 3,446,503 | 5/1969 | Lawton | 482/96 |
| 4,743,010 | 5/1988 | Geraci | 482/72 |
| 5,299,997 | 4/1994 | Chen | 482/72 |

FOREIGN PATENT DOCUMENTS

| | | | |
|---|---|---|---|
| 0495304 | 8/1953 | Canada | 482/96 |

*Primary Examiner*—Stephen R. Crow

*Attorney, Agent, or Firm*—Browdy & Neimark

[57] ABSTRACT

A gymnastic apparatus comprises a base, a treading member, a handle rod, a seat rod, a first linking member, and a second linking member. The base has a support frame mounted thereon. The treading member has a rotary shaft pivoted to the support frame, two pedal rods fastened respectively to both ends of the rotary shaft, and two pedals pivoted respectively to the free ends of the two pedal rods. The handle rod is provided at the top end thereof with two hand grips and pivoted at the bottom end thereof to the base. The seat rod is pivoted at the bottom end thereof to the base and is provided at the top end thereof with a seat cushion. The first linking member is disposed between the rotary shaft of the treading member and the handle rod such that the rotational motion of the rotary shaft is caused to link with the angular displacement motion of the handle rod. The second linking member is located between the handle rod and the seat rod such that the handle rod is caused to link with the angular displacement motion of the seat rod.

4 Claims, 2 Drawing Sheets

GYMNASTIC APPARATUS CAPABLE OF ANIMATING HORSE RIDING

FIELD OF THE INVENTION

The present invention relates generally to a gymnastic apparatus, and more particularly to a gymnastic apparatus capable of providing a user thereof with an animated horse-riding.

BACKGROUND OF THE INVENTION

The conventional gymnastic apparatus capable of imitating a horse-riding is generally provided with two handles, two foot treads and a seat, which work together to provide a user thereof with an animated horse-riding. However, such a conventional gymnastic apparatus as described above is made up of complex linking components, which are incapable of bringing about a good motion animating a horse-riding.

SUMMARY OF THE INVENTION

It is therefore the primary objective of the present invention to provide a gymnastic apparatus having a refined construction and capable of providing its user with a truly animated horse riding.

The foregoing objective of the present invention is attained by a gymnastic apparatus, which comprises a base, a treading member, a handle rod, a seat rod, a first linking member, and a second linking member. The base has a support frame mounted thereon. The treading member has a rotary shaft pivoted to the support frame, two pedal rods fastened respectively to both ends of the rotary shaft, and two pedals pivoted respectively to the free ends of the two pedal rods. The handle rod is provided at the top end thereof with two hand grips and pivoted at the bottom end thereof to the base. The seat rod is pivoted at the bottom end thereof to the base and is provided at the top end thereof with a seat cushion. The first linking member is disposed between the rotary shaft of the treading member and the handle rod such that the rotational motion of the rotary shaft is caused to link with the motion of the angular displacement of the handle rod. The second linking member is located between the handle rod and the seat rod such that the handle rod is caused to link with the motion of the angular displacement of the seat rod.

DETAILED DESCRIPTION OF THE INVENTION

Figure 1:
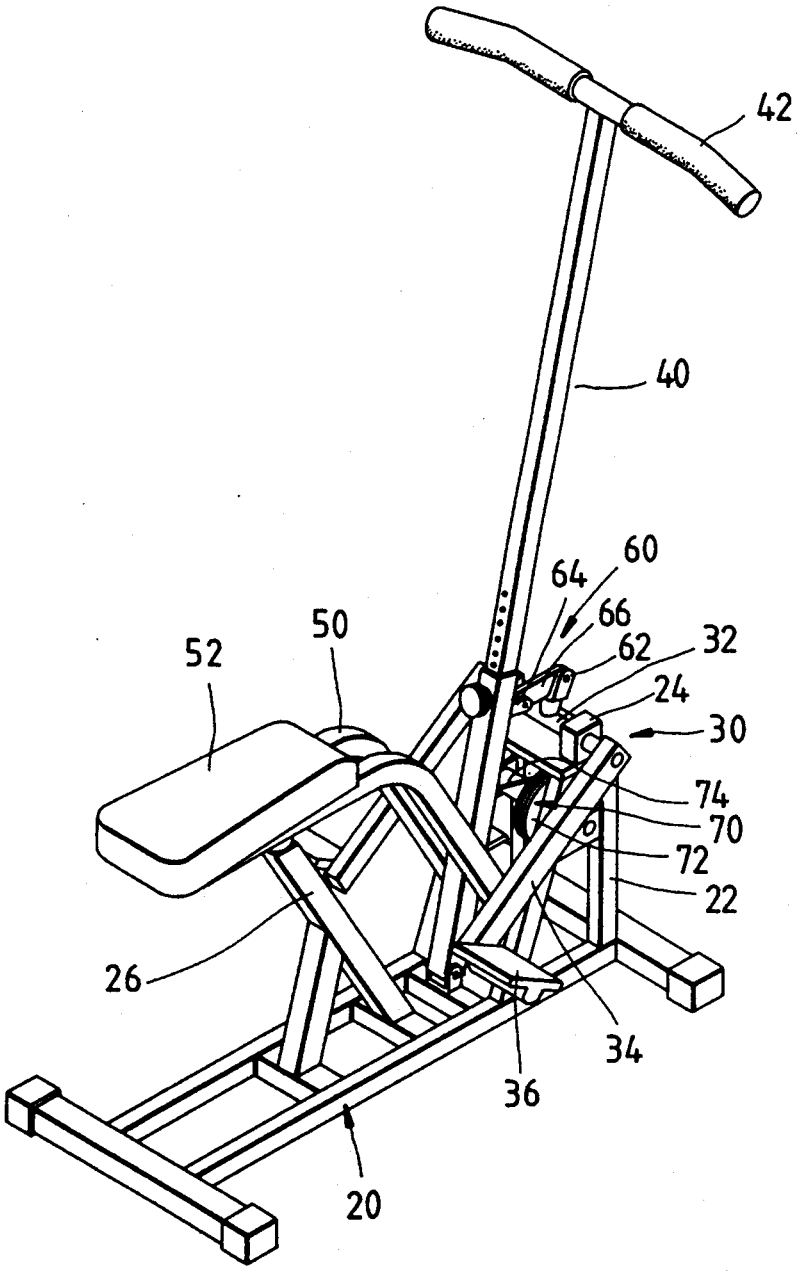
FIG. 1 shows a perspective view of a preferred embodiment of the present invention.
Figure 2:
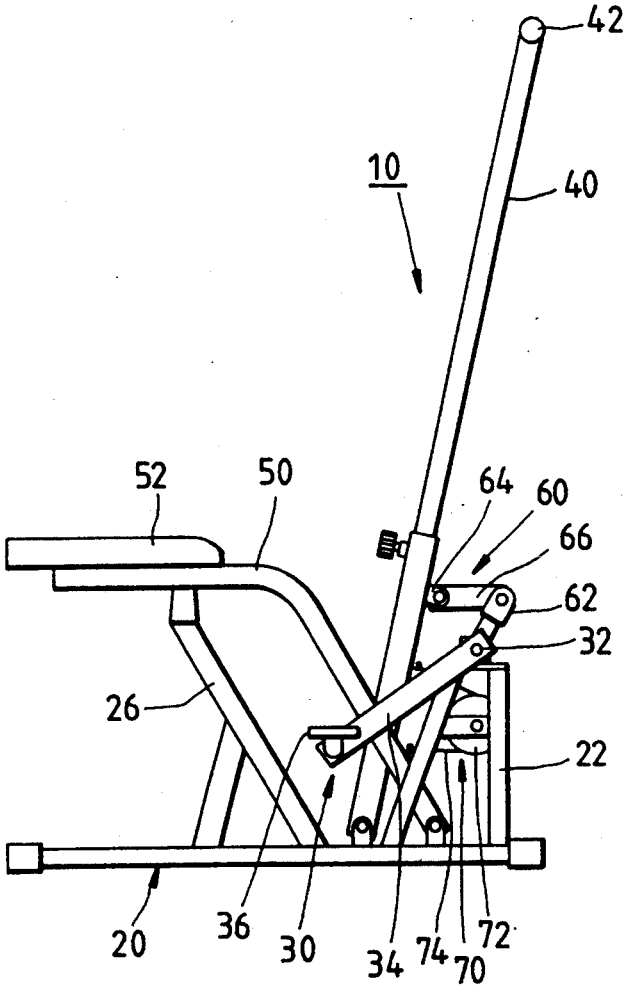
FIG. 2 shows a side elevational view of the preferred embodiment of the present invention.
Figure 3:
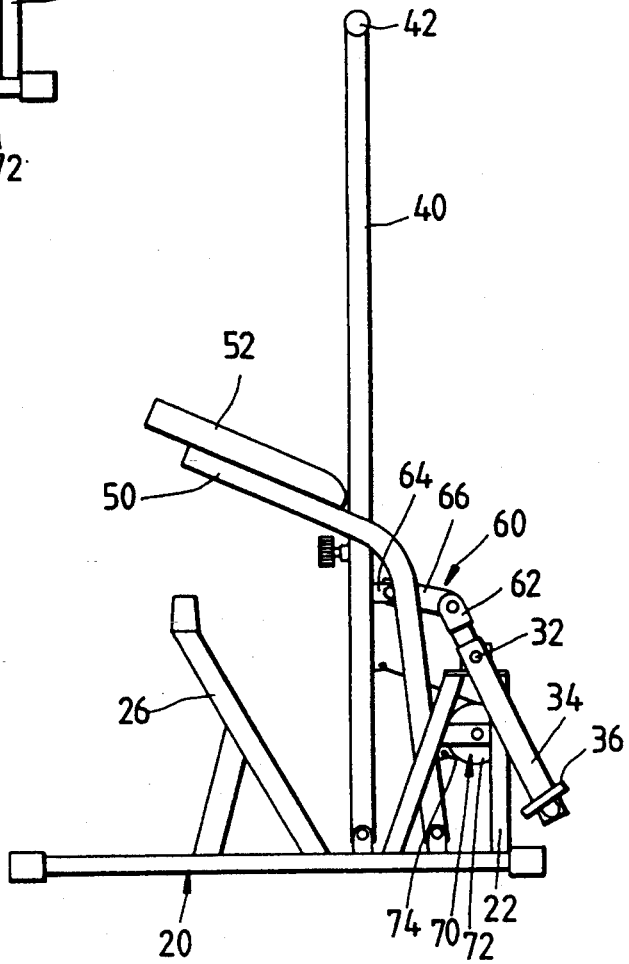
FIG. 3 shows a side elevational view of the preferred embodiment at work, according to the present invention.

Referring to FIGS. 1-3, a gymnastic apparatus 10 embodied in the present invention is shown to comprise the component parts described hereinafter.

A base 20 is provided thereon at one end thereof with a support frame 22.

A treading member 30 has a rotary shaft 32 which is pivoted horizontally to a pivoting portion 24 located at the top end of the support frame 22. Two pedal rods 34 are fastened respectively to both ends of the rotary shaft 32 such that the pedal rods 34 can actuate the rotary shaft 32 to turn. Two pedals 36 are pivoted respectively to the free ends of the two pedal rods 34.

A handle rod 40 is adjustable in length and provided at the top end thereof with a hand grip 42. The handle rod 40 is pivoted at the bottom thereof to the base 20 such that the handle rod 40 is located behind the support frame 22.

A seat rod 50 is pivoted at one end thereof to the base 20 and provided at the free end thereof with a seat cushion 52, which is located behind the handle rod 40. The free end of the seat rod 50 is supported by a bracing rod 26.

A first linking member 60 comprises a connecting member 62 fastened to the rotary shaft 32 of the treading member 30, a connecting member 64 fastened to the front end of the handle rod 40 and corresponding in location to the rotary shaft 32, and a connection rod 66 pivoted to the two connecting members 62 and 64. The first linking member 60 is capable of converting a rotational motion of the rotary shaft 32 into a linear motion for pushing the angular displacement of the handle rod 40.

A second linking member 70 has a wheel 72 mounted on a shaft fastened to the support frame 22, and a linking member 74 of a steel cable and winding along the grooves of the wheel 72. The linking member 74 has two extension ends capable of effecting a reverse motion, with one end being fastened to the handle rod 40 and with another end being fastened to the seat rod 50 for causing the handle rod 40 and the seat rod 50 to be linked together.

In operation, an exerciser is required to sit on the seat cushion 52, with both hands holding firmly the hand grip 42 and with both feet treading forward the two pedals 36 for causing the rotary shaft 32 to turn, as shown in FIGS. 2 and 3. As the rotary shaft 32 is actuated to turn, the handle rod 40 is pushed backward by the linking motion of the first linking member 60. The handle rod 40 can be further pulled backward by both hands of the exerciser. The rotational motion of the rotary shaft 32 and the angular displacement motion of the handle rod 40 are constantly kept by the first linking member 60 in an orderly linking relationship, thereby bringing about the backward angular displacement of the handle rod 40. As the backward angular displacement of the handle rod 40 takes place, one end of the linking member 74 of the second linking member 60 is pulled backward. As a result, the seat rod 50 is caused to move forward by another end of the linking member 74. The seat cushion 52 is therefore caused to move forward and upwards by the forward angular displacement of the seat rod 50.

As the handle rod 40 and the pedals 36 are relieved of the forces exerting thereon respectively by both hands and feet of the exerciser sitting on the seat cushion 52, the seat rod 50 is caused to move back to its initial position by a drop in gravity. Any further backward angular displacement of the seat rod 50 is prevented by the bracing rod 26. However, as the backward angular displacement of the seat rod 50 is under way, one end of the linking member 74 is caused to move backward, thereby causing another end of the linking member 74 to pull handle rod 40 forward to locate at the initial position of the handle rod 40, as shown in FIG. 2. When the forward angular displacement of the linking member 74 is resumed, the rotary shaft 32 of the treading member 30 is once again caused to turn by the linking motion of the first linking member 60, thereby bringing about the backward angular displacement of the two pedal rods 34 to locate at their initial positions, as shown in FIG. 2. As the exerciser repeats the process described above in conjunction with FIGS. 2 and 3, both hands, both feet and the hip of the exercise are caused to move simultaneously in a manner mimicking the horse riding.

What is claimed is:

1. A gymnastic apparatus capable of animating a horse riding and comprising:

a base having a front end provided with a support frame fastened thereto;

a treading member provided with two pedals and pivoted to said support frame;

a handle rod pivoted to said base;

a seat rod pivoted to said base and located behind said handle rod, said seat rod having a seat cushion fastened thereto; and a plurality of linking members for transmitting motion among said treading member, said handle rod and said seat rod;

wherein said treading member has a rotary shaft pivoted to said support frame, two pedal rods fastened respectively to both ends of said rotary shaft, and two pedals fastened respectively to two free ends of said two pedal rods; and wherein said linking members include a first linking member and a second linking member, with said first linking member being located between said rotary shaft of said treading member and said handle rod for linking a rotational motion of said rotary shaft with an angular displacement motion of said handle rod, and with said second linking member being mounted on said base or said support frame such that two extension ends of said second linking member are connected respectively with said handle rod and said seat rod for linking an angular displacement motion of said handle rod with an angular displacement motion of said seat rod, said two extension ends of said second linking member capable of bringing about a reverse motion.

2. The gymnastic apparatus of claim 1 wherein said first linking member comprises a first connecting member fastened to said rotary shaft of said treading member, a second connecting member fastened to said handle rod, and a connection rod pivoted to said first connecting member and said second connecting member.

3. The gymnastic apparatus of claim 1 wherein said second linking member comprises a wheel pivoted to said support frame, and a linking member wound on said wheel such that one end of said linking member is fastened to said handle rod, and that another end of said linking member is fastened to said seat rod.

4. The gymnastic apparatus of claim 1 wherein said base is provided with a bracing rod corresponding in location to a free end of said seat rod.

* * * * *